US011253983B2

(12) United States Patent
Chiang

(10) Patent No.: US 11,253,983 B2
(45) Date of Patent: Feb. 22, 2022

(54) TORQUE SCREWDRIVER DEVICE

(71) Applicant: SHIN YING ENTPR CO., LTD., Taichung (TW)

(72) Inventor: Wen-Hung Chiang, Taichung (TW)

(73) Assignee: SHIN YING ENTPR CO., LTD., Taichung (TW)

( * ) Notice: Subject to any disclaimer, the term of this patent is extended or adjusted under 35 U.S.C. 154(b) by 131 days.

(21) Appl. No.: 16/734,927

(22) Filed: Jan. 6, 2020

(65) Prior Publication Data

US 2021/0205968 A1 Jul. 8, 2021

(51) Int. Cl.

| | |
|---|---|
| ***B25B 23/14*** | (2006.01) |
| ***B25B 23/00*** | (2006.01) |
| *B25B 23/145* | (2006.01) |
| *B25B 23/142* | (2006.01) |
| *B25B 23/147* | (2006.01) |

(52) U.S. Cl.

CPC ..... *B25B 23/141* (2013.01); *B25B 23/0007* (2013.01); *B25B 23/145* (2013.01); *B25B 23/147* (2013.01); *B25B 23/1427* (2013.01)

(58) Field of Classification Search

CPC ..... B23B 23/141; B23B 23/0007; B23B 23/1427; B23B 23/145; B23B 23/147; B23B 23/14; B23B 23/142; B23B 23/1422; B23B 23/1456; B23B 23/1475

USPC ..... 81/473–476

See application file for complete search history.

(56) References Cited

U.S. PATENT DOCUMENTS

| | | | | |
|---|---|---|---|---|
| 3,942,337 A * | 3/1976 | Leonard | B25B 23/141 | 464/36 |
| 4,947,714 A * | 8/1990 | Fluri | B25B 23/0064 | 81/475 |
| 5,437,524 A * | 8/1995 | Huang | B25B 23/14 | 192/69.1 |
| 5,727,590 A * | 3/1998 | Julicher | E03B 9/06 | 137/296 |
| 7,503,443 B1 * | 3/2009 | Dobras | B25B 23/141 | 192/48.6 |
| 7,997,169 B1 * | 8/2011 | Hack | B25B 23/0035 | 81/177.2 |
| 2011/0067534 A1 * | 3/2011 | Cheng | B25B 23/141 | 81/470 |

(Continued)

*Primary Examiner* — Joseph J Hail
*Assistant Examiner* — Michael A Gump
(74) *Attorney, Agent, or Firm* — Muncy, Geissler, Olds & Lowe, P.C.

(57) ABSTRACT

A torque screwdriver device is provided, including: a housing, including a barrel and a cover coveringly connected with the barrel; an input shaft portion, rotatably assembled with the barrel; an output shaft portion, rotatably assembled with the barrel and including a socket mechanism; a torque clutch mechanism, including a first engaging portion disposed on the input shaft portion and a second engaging portion disposed on the output shaft portion, an elastic preload member biasing one of the first and second engaging portions, and a first bearing mechanism, the first bearing mechanism including a stop member abutted against the housing, a support member and at least one low friction member disposed between the stop member and the support member, at least one of the stop member and the support member being movable relative to the at least one low friction member.

7 Claims, 5 Drawing Sheets

(56) References Cited

U.S. PATENT DOCUMENTS

| | | | | |
|---|---|---|---|---|
| 2011/0265611 | A1* | 11/2011 | Raman | B23P 19/069 81/57.22 |
| 2013/0180819 | A1* | 7/2013 | You | B25B 23/141 192/56.62 |
| 2018/0154504 | A1* | 6/2018 | Chou | B25B 23/141 |

* cited by examiner

TORQUE SCREWDRIVER DEVICE

BACKGROUND OF THE INVENTION

Field of the Invention

The present invention relates to a torque screwdriver device.

Description of the Prior Art

A socket tool can be used to tighten or loosen fasteners such as screws, nuts or the like. However, generally, the conventional socket tool is integrally formed of one piece and provided without any torque control mechanism, thus being easy to damage the fastener due to overloaded force.

In addition, the conventional socket tool includes a female connection hole. Therefore, an extension rod has to be connected with a power tool first, and the conventional socket tool can then be connected with the extension rod, which resulting in inconvenient connection with various power tools.

If you want to use a power tool with a tool, you must first connect the power tool through a post, and then the socket tool is sleeved on the post. It cannot be easily and quickly applied to various power tools, and it is extremely inconvenient to use.

The present invention is, therefore, arisen to obviate or at least mitigate the above-mentioned disadvantages.

SUMMARY OF THE INVENTION

The main object of the present invention is to provide a torque screwdriver device suitable for various driving tools and easy to change an object assembled thereon.

To achieve the above and other objects, the present invention provides a torque screwdriver device, including: a housing, including a barrel and a cover coveringly connected with the barrel; an input shaft portion, rotatably assembled with the barrel and protrusive beyond the cover, configured to be detachably assembled with a rotation tool; an output shaft portion, rotatably assembled with the barrel and including a socket mechanism configured for insertion of an object; a torque clutch mechanism, including a first engaging portion and a second engaging portion which are clutchably engagable with each other, an elastic preload member and a first bearing mechanism, the first engaging portion being disposed on the input shaft portion, the second engaging portion being disposed on the output shaft portion, the elastic preload member biasing one of the first and second engaging portions, the first bearing mechanism including a stop member abutted against the housing, a support member abutted against the elastic preload member and at least one low friction member disposed between the stop member and the support member, at least one of the stop member and the support member being movable relative to the at least one low friction member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
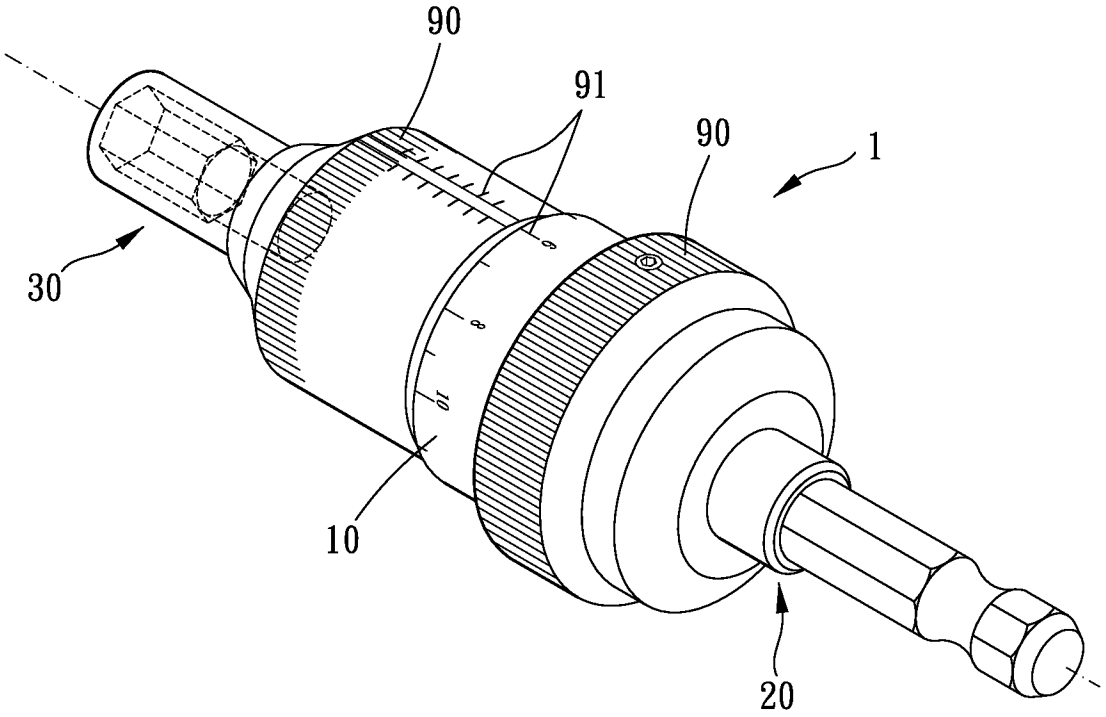
FIG. 1 is a stereogram of a preferable embodiment of the present invention.
Figure 2:
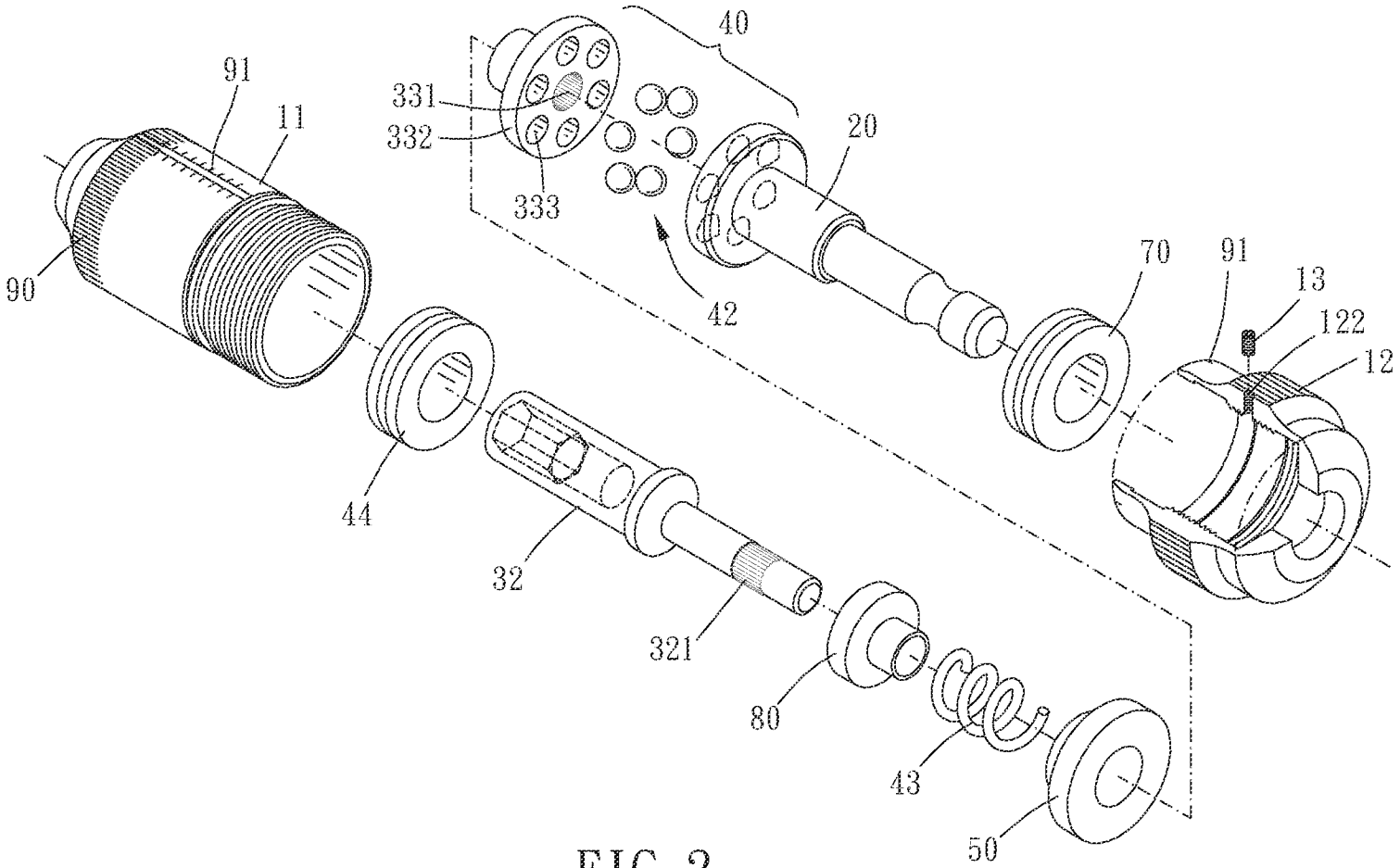
FIG. 2 is a breakdown drawing of a preferable embodiment of the present invention.
Figure 3:
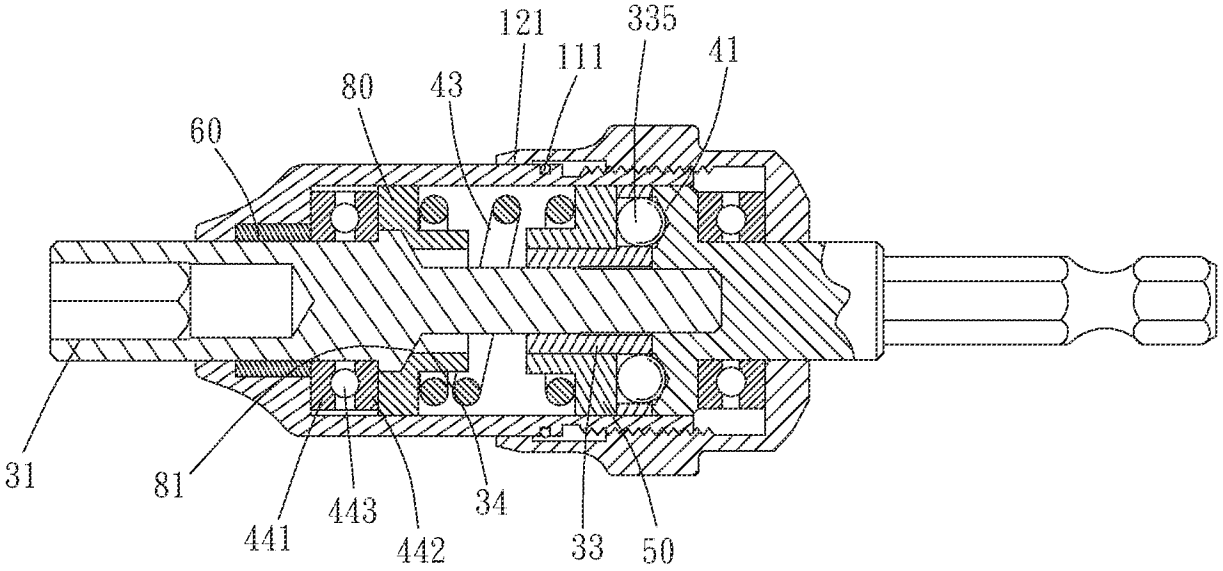
FIG. 3 is a cross-sectional view of a preferable embodiment of the present invention.
Figure 4:
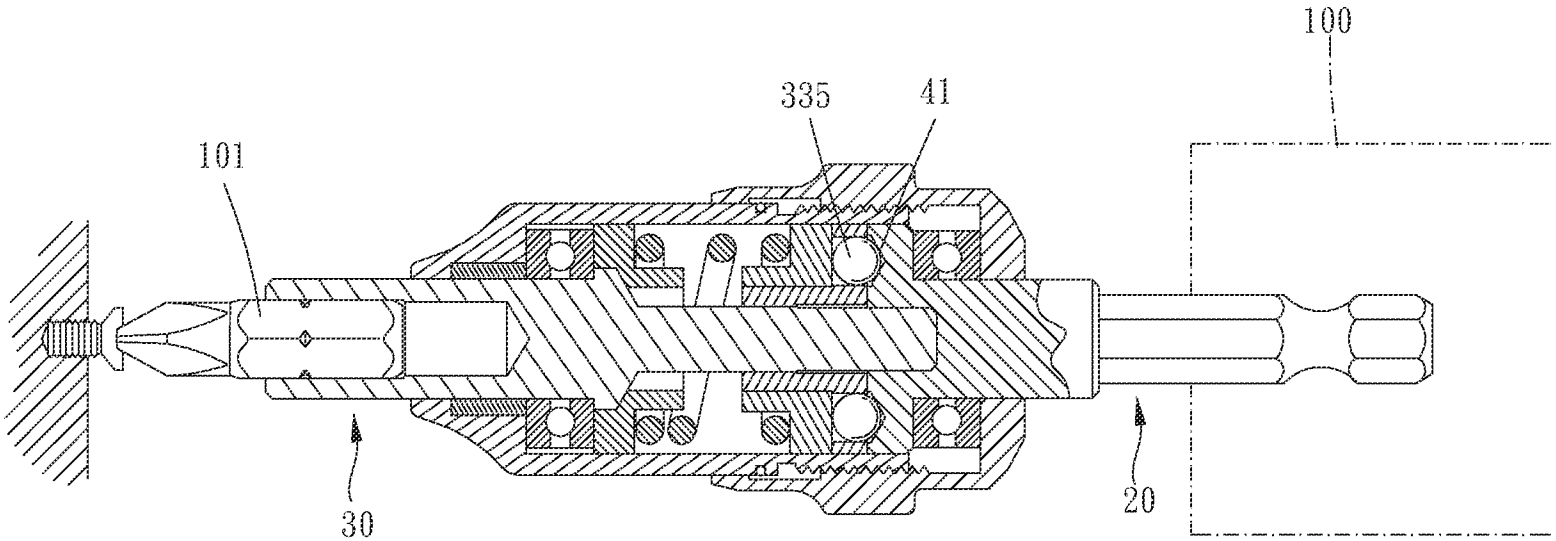
FIGS. 4 and 5 are drawings showing operation of a preferable embodiment of the present invention.
Figure 5:
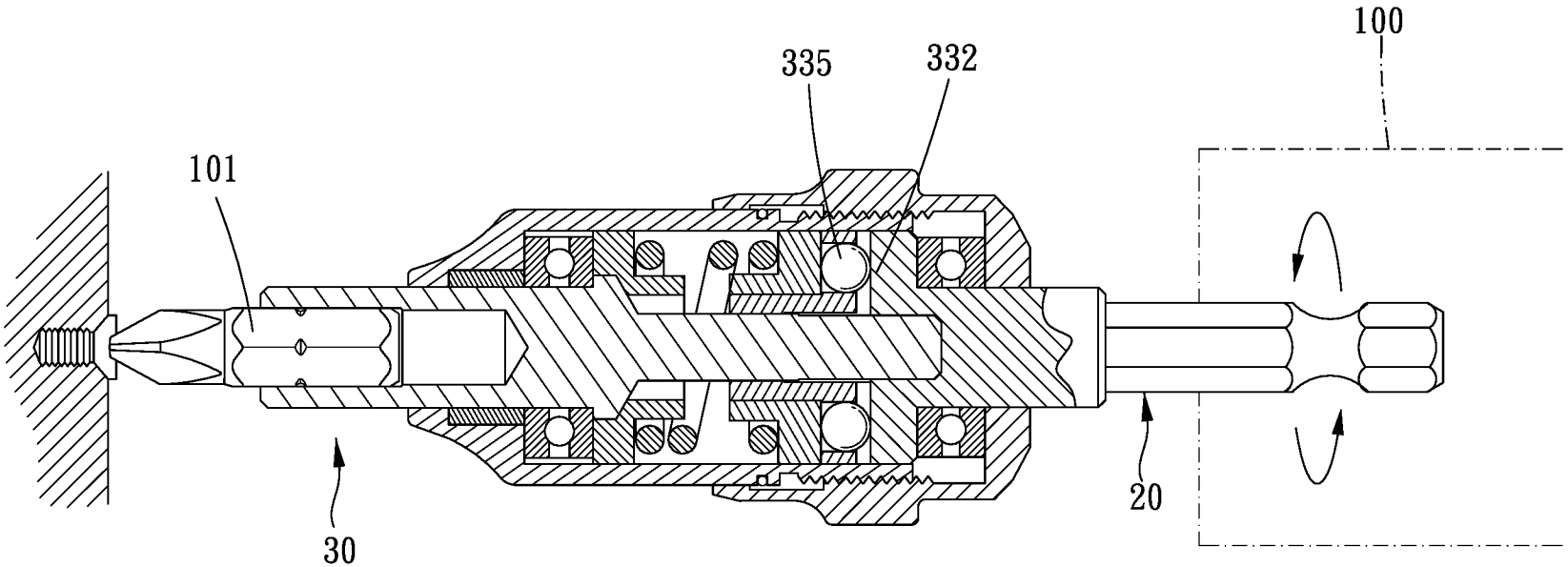

Please refer to FIGS. 1 to 5 for a preferable embodiment of the present invention. A torque screwdriver device 1 of the present invention includes a housing 10, an input shaft portion 20, an output shaft portion 30 and a torque clutch mechanism 40.

The housing 10 includes a barrel 11 and a cover 12 coveringly connected with the barrel; the input shaft portion 20 is rotatably assembled with the cover and protrusive beyond the cover and is configured to be detachably assembled with a rotation tool 100 (manual, pneumatic or electrical tool); the output shaft portion 30 is rotatably assembled with the barrel and includes a socket mechanism 31 configured for insertion of an object 101 (tool head, extension rod, socket or the like); the torque clutch mechanism 40 includes a first engaging portion 41 and a second engaging portion 42 which are clutchably engagable with each other, an elastic preload member 43 and a first bearing mechanism 44. The first engaging portion is disposed on the input shaft portion, the second engaging portion is disposed on the output shaft portion, and the elastic preload member biases the first engaging portion and the second engaging portion. The first bearing mechanism includes a stop member 441 abutted against the housing, a support member 442 abutted against the elastic preload member, and at least one low friction member 443 disposed between the stop member and the support member between, at least one of the stop member and the support member is movable relative to the at least one low friction member. Whereby, the torque screwdriver device is suitable for various driving tools and easy to change an object assembled thereon.

The cover 12 and the barrel 11 is screwed or adjustably connected with each other, an outer surface of the barrel includes a first restriction projective portion 111, and an inner surface of the cover includes a second restriction projective portion 121 blockable with the first restriction projective portion in a direction in which the barrel and the cover move away from each other, which can limits the maximum torque value and prevents detachment of the cover and the barrel. The first restriction projective portion is a ring member engaged into (or integrally formed on) the barrel, or the first restriction projective portion is a projection projecting from the outer surface of the barrel, and the second restriction projective portion is a flange integrally formed on the cover. The cover includes a threaded hole 122 disposed therethrough, and a stop screw 13 is screwed into the threaded hole and releasably position the barrel, thus avoiding unexpected torque change. Preferably, each of the cover and the barrel includes an anti-slip structure 90, for stable and non-slip gripping; and the cover and the barrel each include an index portion 91 (such as scale) corresponding to one another, for quickly reading of the torque value.

At least one (preferably both) of the stop member 441 and the support member 442 includes a recess 444 configured to receive the at least one low friction member 443, and the recess is preferably an annular groove, thus reducing friction.

The output shaft portion 30 further includes a first axial member 32 and a sleeve member 33 sleeved on the first axial member, the sleeve member is co-movable with the first axial member and the second engaging portion 42 is disposed on the sleeve member 32. The first axial member is rotatably inserted into the input shaft portion 20, the first axial member includes a first toothed structure 321 arranged circumferentially, and an inner surface of the sleeve member includes a second toothed structure 331 engaged with the first toothed structure. A first restricting ring 50 is disposed around the sleeve member, and the first restricting ring is abutted axially against and between the elastic preload member 43 and the sleeve member, which can improve stability of the elastic preload member. The sleeve member includes a disc 332 which has at least one through hole 333 and at least one detent member 335 which is movably received within the at least one through hole and abutted between the input shaft portion and the first restricting ring. In this embodiment, the sleeve member includes a plurality of said through holes and a plurality of said detent members clutchably engagable within the plurality of said through holes.

The barrel 11 further includes a bush 60, and the bush is disposed around the output shaft portion 30 and located between the barrel and the first bearing mechanism 44. The bush may be a part of the housing. The bush is preferably a copper sleeve having less friction. Preferably, a second bearing mechanism 70 is disposed around the input shaft portion 20, and the second bearing mechanism is located between the cover 12 and the first engaging portion 41, thus reducing frictional resistance. The output shaft portion further includes an inclined shoulder 34 tapered toward the input shaft portion 20, a second restricting ring 80 is disposed around the inclined shoulder, the second restricting ring is abutted axially against the elastic preload member 43, and an inner surface of the second restricting ring includes an inclined face 81 corresponding to and the inclined shoulder, thus reducing contact area with the first bearing mechanism, and stabilizing the output shaft portion.

During operation, when a workpiece (such as a screw) is fastened and the torque force is greater than the elastic force of the elastic preload member 43, the plurality of said detent members 335 and the plurality of said through holes are disengaged from each other, whereby providing constant torque output and avoiding damage to the workpiece.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque screwdriver device, including:

a housing, including a barrel and a cover coveringly connected with the barrel;

an input shaft portion, rotatably assembled with the barrel and protrusive beyond the cover, configured to be detachably assembled with a rotation tool;

an output shaft portion, rotatably assembled with the barrel and including a socket mechanism configured for insertion of an object;

a torque clutch mechanism, including a first engaging portion and a second engaging portion which are clutchably engagable with each other, an elastic preload member and a first bearing mechanism, the first engaging portion being disposed on the input shaft portion, the second engaging portion being disposed on the output shaft portion, the elastic preload member biasing one of the first and second engaging portions, the first bearing mechanism including a stop member abutted against the housing, a support member and at least one low friction member disposed between the stop member and the support member, at least one of the stop member and the support member being movable relative to the at least one low friction member;

wherein the output shaft portion includes a first axial member and a sleeve member sleeved on the first axial member, the sleeve member is co-movable with the first axial member, and the second engaging portion is disposed on the sleeve member;

wherein the first axial member is rotatably inserted into the input shaft portion, the first axial member includes a first toothed structure arranged circumferentially, and an inner surface of the sleeve member includes a second toothed structure engaged with the first toothed structure;

wherein a first restricting ring is disposed around the sleeve member, and the first restricting ring is abutted axially against and between the elastic preload member and the sleeve member.

2. The torque screwdriver device of claim 1, wherein the cover and the barrel are screwed with each other, an outer surface of the barrel includes a first restriction projective portion, an inner surface of the cover includes a second restriction projective portion blockable with the first restriction projective portion in a direction in which the barrel and the cover move away from each other.

3. The torque screwdriver device of claim 2, wherein the first restriction projective portion is a ring member engaged into the barrel, and the second restriction projective portion is a flange integrally formed on the cover.

4. The torque screwdriver device of claim 1, wherein the sleeve member includes a disc which has at least one through hole, and the second engaging portion includes at least one detent member which is movably received within the at least one through hole and abutted between the input shaft portion and the first restricting ring.

5. The torque screwdriver device of claim 1, wherein the barrel further includes a bush, and the bush is disposed around the output shaft portion and located between the barrel and the first bearing mechanism.

6. The torque screwdriver device of claim 1, wherein the barrel further includes a bush which is a copper sleeve, the bush is disposed around the output shaft portion and located between the barrel and the first bearing mechanism; the cover and the barrel are screwed with each other, an outer surface of the barrel includes a first restriction projective portion, an inner surface of the cover includes a second restriction projective portion blockable with the first restriction projective portion in a direction in which the barrel and the cover move away from each other; the first restriction projective portion is a ring member engaged into the barrel, and the second restriction projective portion is a flange integrally formed on the cover; at least one of the stop member and the support member includes a recess configured to receive the at least one low friction member; the sleeve member includes a disc which has at least one through hole, and the second engaging portion includes at least one detent member which is movably received within the at least one through hole and abutted between the input shaft portion and the first restricting ring; a second bearing mechanism is disposed around the input shaft portion, the second bearing mechanism is located between the cover and the first engaging portion; the cover includes a threaded hole disposed therethrough, and a stop screw is screwed into the threaded hole and releasably positions the barrel.

7. A torque screwdriver device, including:

a housing, including a barrel and a cover coveringly connected with the barrel;

an input shaft portion, rotatably assembled with the barrel and protrusive beyond the cover, configured to be detachably assembled with a rotation tool;

an output shaft portion, rotatably assembled with the barrel and including a socket mechanism configured for insertion of an object;

a torque clutch mechanism, including a first engaging portion and a second engaging portion which are clutchably engagable with each other, an elastic preload member and a first bearing mechanism, the first engaging portion being disposed on the input shaft portion, the second engaging portion being disposed on the output shaft portion, the elastic preload member biasing one of the first and second engaging portions, the first bearing mechanism including a stop member abutted against the housing, a support member and at least one low friction member disposed between the stop member and the support member, at least one of the stop member and the support member being movable relative to the at least one low friction member;

wherein the output shaft portion further includes an inclined shoulder tapered toward the input shaft portion, a second restricting ring is disposed around the inclined shoulder, the second restricting ring is abutted axially against the elastic preload member, and an inner surface of the second restricting ring includes an inclined face corresponding to the inclined shoulder.

* * * * *